US010153575B2

(12) United States Patent
Stolze

(10) Patent No.: US 10,153,575 B2
(45) Date of Patent: Dec. 11, 2018

(54) CONDUCTOR CONNECTION CONTACT ELEMENT

(71) Applicant: WAGO Verwaltungsgesellschaft mbH, Minden (DE)

(72) Inventor: Henry Stolze, Bad Frankenhausen (DE)

(73) Assignee: WAGO Verwaltungsgesellschaft mgH, Minden (DE)

( * ) Notice: Subject to any disclaimer, the term of this patent is extended or adjusted under 35 U.S.C. 154(b) by 0 days.

(21) Appl. No.: 15/902,516

(22) Filed: Feb. 22, 2018

(65) Prior Publication Data

US 2018/0254567 A1 Sep. 6, 2018

(30) Foreign Application Priority Data

Mar. 1, 2017 (DE) ..... 20 2017 101 148 U

(51) Int. Cl.

| | |
|---|---|
| ***H01R 13/187*** | (2006.01) |
| ***H01R 4/48*** | (2006.01) |
| ***H01R 12/57*** | (2011.01) |
| ***H01R 4/62*** | (2006.01) |
| *H01R 12/53* | (2011.01) |
| *H01R 4/16* | (2006.01) |

(52) U.S. Cl.

CPC ..... *H01R 13/187* (2013.01); *H01R 4/4809* (2013.01); *H01R 4/4818* (2013.01); *H01R 4/4836* (2013.01); *H01R 4/625* (2013.01); *H01R 12/57* (2013.01); *H01R 4/16* (2013.01); *H01R 4/4881* (2013.01); *H01R 12/53* (2013.01)

(58) Field of Classification Search

CPC ... H01R 4/4809; H01R 4/4881; H01R 13/187
See application file for complete search history.

(56) References Cited

U.S. PATENT DOCUMENTS 4,299,436 A * 11/1981 Ackerman ..... H01R 12/55 439/853
5,679,034 A * 10/1997 Hanazaki ..... H01R 13/187 439/845
5,702,272 A * 12/1997 Machida ..... H01R 13/113 439/843
6,050,862 A * 4/2000 Ishii ..... H01R 13/187 439/843

(Continued)

FOREIGN PATENT DOCUMENTS

DE 10 2013 111 649 A1 5/2014

*Primary Examiner* — James Harvey
(74) *Attorney, Agent, or Firm* — Muncy, Geissler, Olds & Lowe, P.C.

(57) ABSTRACT

A conductor connection contact element for clamping an electrical conductor having at least one resilient force clamping connection. At least one first SMD-solder contact is arranged on an assembly face of the conductor connection contact element and configured for soldering to a contact surface. A conductor inserting region is formed by a sheet metal part of the conductor connection contact element. At least one conductor guiding base is oriented so as to form a guiding surface for the electrical conductor that is to be inserted. A material portion of the sheet metal part is adapted to be bent over at least one curved region to form a first SMD-solder contact and a region of the conductor guiding base that is oriented in an oblique manner with respect to the conductor inserting direction is adjacent to the at least one curved region.

26 Claims, 5 Drawing Sheets

(56) References Cited

U.S. PATENT DOCUMENTS

| | | | | |
|---|---|---|---|---|
| 6,171,155 | B1 * | 1/2001 | Miwa | H01R 13/187 439/845 |
| 6,758,701 | B2 * | 7/2004 | Kato | H01R 13/187 439/852 |
| 7,229,328 | B2 * | 6/2007 | Sawada | H01R 43/16 439/595 |
| 7,351,118 | B1 * | 4/2008 | Duesterhoeft | H01R 4/4836 439/607.01 |
| 9,306,297 | B2 * | 4/2016 | Bishop | H01R 4/4818 |
| 2003/0096540 | A1 * | 5/2003 | Smyk | H01R 13/187 439/843 |
| 2003/0220015 | A1 * | 11/2003 | Ishiyama | H01R 13/187 439/595 |
| 2014/0120783 | A1 | 5/2014 | Bishop | |
| 2018/0212342 | A1 * | 7/2018 | Koellmann | H01R 4/4836 |
| 2018/0254567 | A1 * | 9/2018 | Stolze | H01R 4/4818 |

* cited by examiner

CONDUCTOR CONNECTION CONTACT ELEMENT

This nonprovisional application claims priority under 35 U.S.C. § 119(a) to German Patent Application No. 20 2017 101 148.8, which was filed in Germany on Mar. 1, 2017, and which is herein incorporated by reference.

BACKGROUND OF THE INVENTION

Field of the Invention

The present invention relates to a conductor connection contact element for clamping an electrical conductor, wherein the conductor connection contact element comprises at least one resilient force clamping connection having a clamping site for fixedly clamping the electrical conductor, and wherein the conductor connection contact element is configured as an (SMD-) conductor connection contact element that can be surface-mounted on an electrical circuit board and comprises at least a first SMD-solder contact that is arranged on an assembly face of the conductor connection contact element and is configured for soldering to a contact surface of the circuit board, wherein the conductor connection contact element moreover comprises a conductor inserting region that is formed by a sheet metal part of the conductor connection contact element and comprises at least one conductor guiding base that is oriented in an oblique manner with respect to the conductor inserting direction so as to form a guiding surface for the electrical conductor that is to be inserted.

Description of the Background Art

Conductor connection contact elements having a resilient force clamping connection are used in various forms. The conductor connection contact element in this case is provided and configured so as to be placed directly on a circuit board and to be soldered to the circuit board, as this is known for SMD electronic components (SMD—surface mounted device). The conductor connection contact element in this case may therefore be described as an SMD-conductor connection contact element. Such a conductor connection contact element renders it possible in a simple manner to clamp an electrical conductor by means of a resilient force clamping arrangement to an electrical circuit board and to provide an electrical contact between said electrical conductor and the circuit board. The conductor connection contact element can be configured, for example, as a conductor connection contact element that is not provided with a housing, in other words is used without an encompassing housing made from an insulating material.

An SMD conductor connection contact element is known from DE 10 2013 111 649 A1, which corresponds to US 2014/0120783.

SUMMARY OF THE INVENTION

It is therefore an object of the present invention to provide an improved conductor connection contact element for clamping an electrical conductor.

This object is achieved in an exemplary embodiment with a conductor connection contact element in that a material portion of the sheet metal part that is present in the conductor connection contact element and protrudes from the conductor guiding base is bent over at least one curved region in the direction of the plane of the assembly face to form he first SMD-solder contact, and at least one part region of the conductor guiding base that is oriented in an oblique manner with respect to the conductor inserting direction is adjacent to the at least one curved region. The invention has the advantage that such a conductor connection contact element may be widened by a first SMD-solder contact that is arranged relatively far forward with respect to the conductor inserting direction. This first SMD-solder contact may be realized in a simple and cost-effective manner, in that a material portion of the sheet metal part that protrudes from the conductor guiding base is produced in the conductor inserting region and said material portion is reshaped, in other words is bent, over at least one curved region to form the first SMD-solder contact. The first SMD-solder contact may consequently be configured in one piece with the sheet metal part or the conductor guiding base. As a result of the curved region, the first SMD-solder contact is bent with respect to the conductor guiding base. The material portion of the sheet metal part that is protruding from the conductor guiding base may be bent over a curved region or over multiple curved regions to form the first SMD-solder contact. Depending upon the number of curved regions, this material portion may thus also be bent multiple times.

In an embodiment, in the case of the conductor connection contact element in accordance with the invention, at least one part region of the conductor guiding base that is oriented in an oblique manner with respect to the conductor inserting direction is adjacent to the at least one curved region, in other words by virtue of this part region an additional oblique conductor guiding arrangement is provided in terms of a conductor inserting funnel. Accordingly, it is not necessary for the at least one curved region to assume this technical aspect of guiding the conductor or at least to assume this task alone which has the advantage that irrespective of the design of one or multiple curved regions the conductor guiding base may be optimized separately to create a favorable conductor guiding arrangement. The mentioned part region of the conductor inserting base that is oriented in an oblique manner with respect to the conductor inserting direction may be arranged in the conductor inserting direction, for example, downstream of the first SMD-solder contact or at least downstream of the at least one curved region.

The term "adjacent" includes the option that at least one part region of the conductor guiding base that is oriented in an oblique manner with respect to the conductor inserting direction is directly adjacent to the at least one curved region, in other words directly adjoins said curved region, or is adjacent thereto via another connecting region, consequently the part region of the conductor guiding base that is oriented in an oblique manner with respect to the conductor inserting direction may also be spaced apart from the at least one curved region.

As mentioned, the conductor guiding base is oriented in an oblique manner with respect to the conductor inserting direction so as to form a guiding surface for the electrical conductor that is to be inserted. In this manner, the conductor guiding base forms a conductor inserting slope that simplifies the procedure of inserting the electrical conductor into the conductor connection contact element and its further guidance to the clamping site. It is possible by way of example for the conductor guiding base to be inclined at an angle of 10° to 60° with respect to the contact surface of the first SMD-solder contact, wherein the angle information relates to a circle dimension of 360°. The conductor guiding base that is oriented in an oblique manner with respect to the conductor inserting direction may be configured in a planar or curved manner, for example progressively rising in the conductor inserting direction. However, a planar embodiment of the conductor guiding base is particularly advantageous with the result that it is configured as a ramp that rises in the conductor inserting direction.

The material portion that is protruding from the conductor guiding base and is used to form the first SMD-solder contact may protrude from the conductor guiding base in the opposite direction to the conductor inserting direction or in other words from the conductor guiding base rearward in the conductor inserting direction. Two material portions that protrude from the conductor guiding base may also be provided, wherein one material portion protrudes in the opposite direction to the conductor inserting direction and the other material portion protrudes from the conductor guiding base in the conductor inserting direction. In this case, each of these material portions may be bent to form an SMD-solder contact so that multiple SMD-solder contacts may be formed in one piece on the conductor guiding base.

Such a first SMD-solder contact that is arranged relatively far forward with respect to the conductor inserting direction on the conductor connection contact element renders it possible to increase the stability of the mechanical fastening when the conductor connection contact element is being SMD-soldered to the circuit board in the conductor inserting region. As a consequence, it is possible to better compensate for the transverse forces that are exerted, for example, by the conductor on the conductor connection contact element. It is thus possible as a result in particular to avoid the conductor connection contact element bending in the front region, in other words in the conductor inserting region, and as a result to avoid an electrical conductor that has already been inserted sliding out of the clamping site.

The conductor connection contact element may comprise in addition to the first SMD-solder contact also one or multiple further SMD-solder contacts, in particular SMD-solder contacts that are arranged in the conductor inserting direction downstream of the first SMD-solder contact and are spaced part from the first SMD-solder contact. It is possible as a result to further improve the mechanical fixing arrangement of the conductor connection contact element to the circuit board. It is particularly advantageous to provide in addition to the first SMD-solder contact also at least one second SMD-solder contact that is arranged in the conductor inserting direction further downstream on the conductor connection contact element in order to fasten the conductor connection contact element in a particularly secure and reliable manner to the circuit board.

It is possible for the conductor guiding base to face, for example, the assembly face of the conductor connection contact element, for example in such a manner that the conductor connection contact element comprises a lower face, which forms the assembly face, and an upper face. In this case, the conductor guiding base is arranged closer to the lower face than to the upper face. In an advantageous development, the conductor guiding base is thus spaced apart from the plane of the assembly face. Such a spacing renders it possible to realize in an advantageous manner the at least one curved region.

The first SMD-solder contact may comprise a contact area that is oriented toward the contact surface of the circuit board so as to provide a contact area. The contact area may be spaced apart from the conductor guiding base over the at least one curved region.

In an embodiment of the invention, the contact area of the first SMD-solder contact is formed by an end-face end surface of the material portion of the sheet metal part that protrudes from the conductor guiding base or by a surface of this material portion that adjoins the outer face of the at least one curved region. The SMD-solder contact is wetted with solder as it is being soldered to the contact surface on the contact area and/or on the border regions that surround the contact area. The contact area may lie either directly on the contact surface or by means of a corresponding solder layer between the contact area and the contact surface.

If the end-face end surface forms the contact area, this has the advantage that the material portion of the sheet metal part that is protruding from the conductor guiding base and is required so as to form the SMD-solder contact may be kept short. Accordingly, the amount of additional material required is small with the result that sheet metal sizes and machines that are generally available may still be used to process the sheet metal.

If the contact area is formed by the surface of this material portion that is adjoining the outer face of the at least one curved region, this results in a relatively large soldering area that is parallel to the circuit board being available which ensures that the SMD-solder contact is held against the circuit board in a particularly secure and reliable manner.

It is possible to realize such a large solder area, which has the advantage of providing a particularly secure and reliable hold, by virtue of the fact that the contact area is formed by a surface of the mentioned material portion that is adjoining the inner face of the at least one curved region.

In an embodiment of the invention, it is provided that the material portion of the sheet metal part that protrudes from the conductor guiding base is bent over precisely one curved region or over two curved regions that each curve in the opposite direction to form the first SMD-solder contact. This renders it possible to produce the conductor connection contact element with one or multiple curved regions in a simple manner using conventional sheet metal processing machines. If two curved regions that each curve in the opposite direction are provided, said curved regions may be bent in the side view by way of example substantially in the shape of an S.

In an embodiment of the invention, it is provided that the conductor connection contact element comprises in the conductor inserting region a conductor inserting duct that comprises the conductor guiding base. Such a conductor inserting duct has the advantage that the procedure of inserting the electrical conductor is additionally supported in that walls of this conductor inserting duct encompass the conductor inserting region with the result that the conductor that is being inserted may be guided on all sides in a purposeful manner to the clamping site.

In an embodiment of the invention, it is provided that the clamping site is arranged when viewed in the conductor inserting direction downstream of the conductor inserting base and/or downstream of the first SMD-solder contact. Accordingly, the clamping site is arranged when viewed in the conductor inserting direction relatively far downstream in the conductor connection contact element, for example in the middle or slightly downstream of the middle.

In an embodiment of the invention, it is provided that the first SMD-solder contact protrudes in the opposite direction of the conductor inserting direction from the conductor guiding base over the conductor inserting region of the conductor connection contact element. This renders it possible in a particularly simple manner to solder the first SMD-solder contact to the circuit board. Alternatively, the first SMD-solder contact may also be configured in such a manner that it does not protrude or does not significantly protrude in the opposite direction to the conductor inserting direction from the conductor guiding base over the conductor inserting region of the conductor connection contact element. This renders possible a particularly short embodiment of the conductor connection contact element.

In an embodiment of the invention, it is provided that the conductor guiding base is formed by at least two mutually separate material portions of the sheet metal part or different sheet metal parts and the first SMD-solder contact is formed from an extended material portion from one of the sheet metal parts or the two sheet metal parts. As a result, the options for realizing the first SMD-solder contact are still further increased. In particular, the flexibility with regard to producing the conductor connection contact element using the sheet metal part is further improved.

In an embodiment of the invention, it is provided that the conductor connection contact element comprises a second SMD-solder contact that is arranged in the conductor inserting direction downstream of the first SMD-solder contact. Consequently, the conductor connection contact element may be soldered at at least two sites to the circuit board with the result that the mechanical stability of the conductor connection contact element on the circuit board is further improved.

In an embodiment of the invention, it is provided that the conductor connection contact element comprises as parts of the resilient force clamping connection for clamping an electrical conductor a current rail piece that is formed from the sheet metal part of the conductor connection contact element or from another sheet metal part having a first side wall and a second side wall that is lying opposite the first side wall, a base portion that extends from the first side wall to the opposite-lying second side wall, and a cover portion that lies opposite the base portion and extends from the first side wall to the opposite-lying second side wall, wherein the side walls together with the cover portion and the base portion or the conductor guiding base delimit a conductor inserting duct, and having a clamping spring that is arranged on the current rail piece and at a first end region comprises a contacting portion and at the second end region that lies opposite the first end region comprises a clamping portion having a clamping edge for clamping the electrical conductor, wherein the contacting portion is arranged on the base portion of the current rail piece and wherein the clamping portion extends with its freely-movable end to the cover portion. It is possible in this manner to realize the conductor connection contact element in an efficient and cost-effective manner with respect to the conductor inserting duct and the resilient force clamping connection. In addition, the assembly outlay for the individual parts is low. In particular, the clamping spring may be configured as a separate component, in other words separate from the current rail piece. The current rail piece may be formed as one piece from the sheet metal part, or as a multi-piece from multiple sheet metal parts. It is thus possible by way of example to realize a conductor connection contact element having only two separate components, namely the current rail piece and the clamping spring.

The conductor connection contact element can be embodied in such a manner that the base portion comprises at least one recess that is arranged between the first SMD-solder contact and the second SMD-solder contact. The recess may extend, for example, over the entire width of the conductor connection contact element, in other words at least from the first side wall to the opposite-lying second side wall. In this manner, the first SMD-solder contact is only indirectly mechanically and electrically connected to the second SMD-solder contact, in other words is not connected or is essentially not connected via the base portion but rather is connected via one or multiple of the parts: first side wall, second side wall, cover portion. The recess provides in particular a free space in which parts of the clamping spring, for example a part of the resilient bend, may be arranged in a space-saving manner.

The second SMD-solder contact may be arranged in particular within the tunnel-shaped region of the conductor connection contact element that is formed by the base portion, the cover portion and the first and the second side wall, for example in such a manner that the second SMD-solder contact does not protrude rearward (when viewed in the conductor inserting direction) beyond the side walls and the cover part. The second SMD-solder contact may be in particular part of the base portion.

In an embodiment of the invention, it is provided that an actuating portion that is accessible for an actuating tool is provided when viewed in a transverse manner with respect to the conductor inserting direction of the clamping portion in the direction of the side wall adjacent to the clamping edge. The conductor connection contact element is configured with the aid of the actuating portion on the clamping portion in such a manner that the clamping site may be opened so as to clamp an electrical conductor by means of an application of force by the actuating portion with the aid of an actuating tool. The clamping edge of the clamping portion that lies adjacent to the actuating portion is moved away from the cover portion of the current rail piece.

The actuating portion may have an actuating lug that protrudes sideward out of the first side wall. This does not prevent the actuating portion having a further actuating lug that protrudes on the opposite-lying face likewise sideward from the clamping portion.

In an embodiment of the invention, it is provided that a conductor guiding element that delimits the clamping portion is formed on the first side wall, wherein the conductor guiding element comprises a portion of the first side wall that is oriented in an oblique manner in the direction of the opposite-lying second side wall. With the aid of the conductor guiding element that is oriented in an oblique manner on the first side wall toward the opposite-lying second side wall, an electrical conductor is moved sideward toward the clamping edge and said conductor guiding element prevents a conductor in its entirety or where appropriate strands of a fine-stranded electric conductor from moving into the region of the actuating portion.

With the aid of this conductor guiding element on the first side wall, a portion of the side wall is consequently provided for guiding an electrical conductor that is to be clamped toward the clamping edge. In addition, this conductor guiding element of the first side wall covers the actuating portion of the clamping spring that has clamping and actuating portions adjacent to one another when viewed in the conductor inserting direction. Consequently, a very compact and reliable conductor connection contact element is produced whose clamping site may be displaced in the direction of the base portion using an actuating tool in order to open the clamping site.

It is possible by means of the actuating lug that protrudes out of the side wall to place an actuating tool against the conductor connection contact element. For this purpose, the actuating tool is placed on the actuating lug and a force for opening the clamping site is exerted on the actuating lug. The actuating tool is preferably a screw driver but may also be the finger of a user.

The conductor connection contact element may have on the first side wall an opening for the through-passage of the actuating lug. The conductor guiding element is oriented facing away from the end edge of the first side wall that delimits the opening and lies opposite the conductor guiding element. This arrangement prevents an electrical conductor that is to be clamped and is inserted in the conductor guiding duct from abutting in its entirety or with its strands against the end edge of the first side wall that is exposed by the opening. The conductor guiding element consequently maintains the opening having the end edges that delimit the opening free from an inserted electrical conductor that is to be clamped.

The conductor guiding element may be formed as a material tongue of the first side wall that is to be oriented in an oblique manner in the direction of the second side wall and on the clamping portion. The material tongue is not connected to the base portion and the cover portion. On the contrary, the material tongue is released from the base portion and the cover portion. The material tongue lies in the intermediate space between the cover portion and the clamping portion with the result that the clamping spring is positioned between the base portion and the material tongue. Consequently, a free space is provided for the clamping spring between the base portion and the cover portion, said free space being in part sealed by the at least one material tongue so as to provide a conductor guiding arrangement.

The actuating portion may have an actuating lug that extends in the direction of the plane of the cover portion. This actuating lug is arranged offset adjacent to the clamping edge in the direction of extension of the clamping portion. As a consequence, the point of contact for the actuating procedure is displaced to the upper face on the cover portion of the conductor connection contact element.

However, it is also conceivable that the actuating portion has an actuating lug that is arranged sideward in an opening in the first side wall that is arranged when viewed in the conductor guiding direction downstream of the free end of the conductor guiding element and can be accessed from the outside.

On the rear end of the current rail piece that lies opposite the conductor inserting duct an end stop, it is also possible to form an end stop by means of a material tab that is bent out from a side wall, from the base portion or from the cover portion. It is consequently possible in a very simple manner to reshape the sheet metal part of the current rail piece in such a manner that a conductor capturing pocket.

It is conceivable that material tabs that are to be oriented toward one another are bent out from the two walls so as to form an end stop.

The contacting portion may be clamped between the side walls and the base portion. It is consequently possible to clamp the clamping spring in a simple manner against the current rail piece and to fix it in position thereon.

However, it is also conceivable that the contacting portion having a fixing portion that protrudes from the contacting portion into an opening of the base portion or having a fixing portion that protrudes from the base portion into an opening in the contacting portion is fixed in position on the current rail piece. The fixing portion may be a lug or an embossed region or similar. Consequently, it is possible in a simple manner to prevent the clamping spring once it has engaged with the current rail piece from sliding out of position.

The clamping spring may have a resilient bend that connects the contacting portion with the clamping portion and consequently may be configured for example as a U-shaped bent leg spring. From at least one side wall, the conductor guiding bend is arranged when viewed in the conductor inserting direction upstream of the resilient bend and is bent in the direction of the opposite-lying side wall. This conductor guiding bend is used so as to guide an electrical conductor past the resilient bend toward the clamping portion. For this purpose, the conductor guiding base is oriented in an oblique manner in the conductor inserting direction facing the cover portion. It is possible to produce this conductor guiding base in a quite simple manner from the sheet metal part by bending a portion of the side wall.

The cover portion or the base portion may have a solder connection region. This solder connection region may be by way of example a solder connection tab that is not attached to the cover portion or base portion. However, it is also conceivable that parts of the cover portion or the base portion itself are used for soldering to a circuit board.

An overload stop may be provided on a side wall, for example in the form of an overload stop lug that extends protruding from the side wall in the direction of the opposite-lying side wall and is positioned in the space between the clamping portion and the base portion. Such a lug may likewise be formed in a very simple manner from the sheet metal part in that said lug is bent over in a portion of the side wall that forms a lateral opening facing into the inner space of the cage-shaped conductor connection contact element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
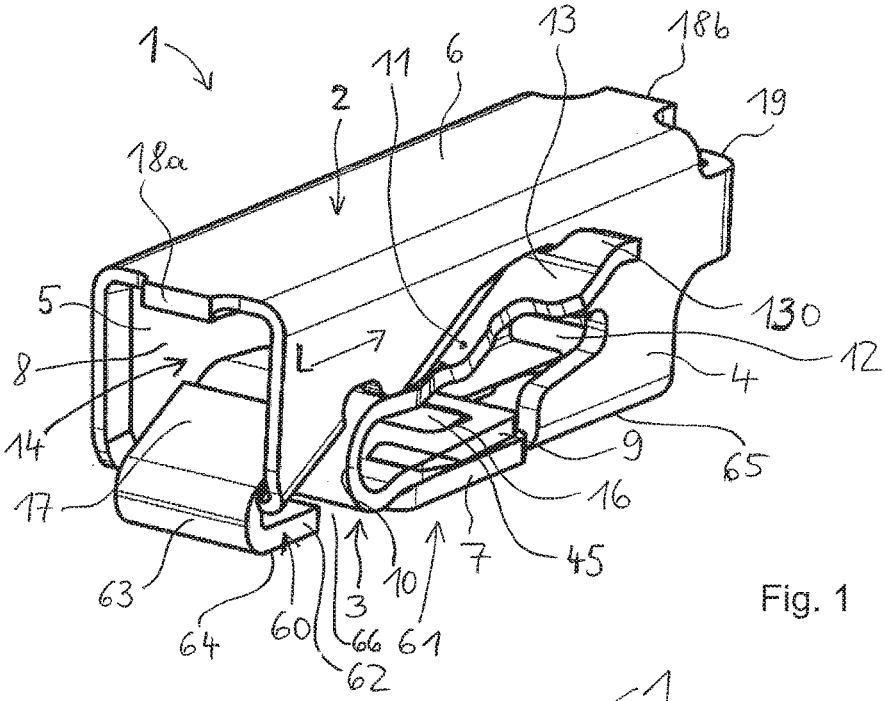
FIG. 1 illustrates a perspective view of a first embodiment of a conductor connection contact element.

FIG. 1 illustrates a perspective view of a first embodiment of a conductor connection contact element 1 that is formed from a current rail piece 2 and a clamping spring 3 that is inserted therein. The current rail piece 2 is formed in a cage-shaped manner from a sheet metal part. It has a first side wall 4 and an opposite-lying second side wall 5. These two side walls 4 and 5 are connected to one another via a cover portion 6. In the illustrated exemplary embodiment, the cover portion 6 is an integral part of the two side walls 4 and 5 and is formed therefrom by means of a bending procedure.

The current rail piece 2 has a base portion 7 that lies opposite to the cover portion 6 and likewise extends from the first side wall 4 to the second side wall 5. The base portion 7 is formed by folding over the second side wall 5 and abuts against the first side wall 4. It is consequently not connected substance-to-substance to the first side wall 4. Conversely, the base portion 7 may also be formed by folding over the first side wall 4 and may extend to the second side wall 5 or may also be formed as a combination of the two options.

A conductor inserting duct 8 that is provided for inserting and guiding an electrical conductor and also for receiving the clamping spring 3 is delimited by virtue of the first and second side walls 4 and 5 that are spaced apart from one another and also the cover portion 6 and the base portion 7 that extend in a transverse manner thereto and likewise are spaced apart from one another.

The clamping spring 3 is configured as a U-shaped bent leg spring having a contacting portion 9 that is placed on the base portion 7, a resilient bend 10 that adjoins said contacting portion, and a clamping portion 11 that protrudes in the conductor inserting direction L, in other words in the direction of the conductor inserting duct 8 or in an oblique manner, into this conductor inserting duct 8. The clamping portion 11 extends with its freely-movable end to the cover portion 6.

It is clear that the first side wall 4 has an opening 12 for the through-passage of an actuating lug 13 that protrudes sideward from the clamping portion 11. It is possible by virtue of exerting an actuating force on the actuating lug 13 to displace the clamping portion 11 in the direction of the contacting portion 9 against the resilient force of the clamping spring 3. As a result, a clamping site that is formed between a clamping edge of the clamping portion 11 and the current rail piece 2 is opened so as to clamp on an electrical conductor.

Figure 3:
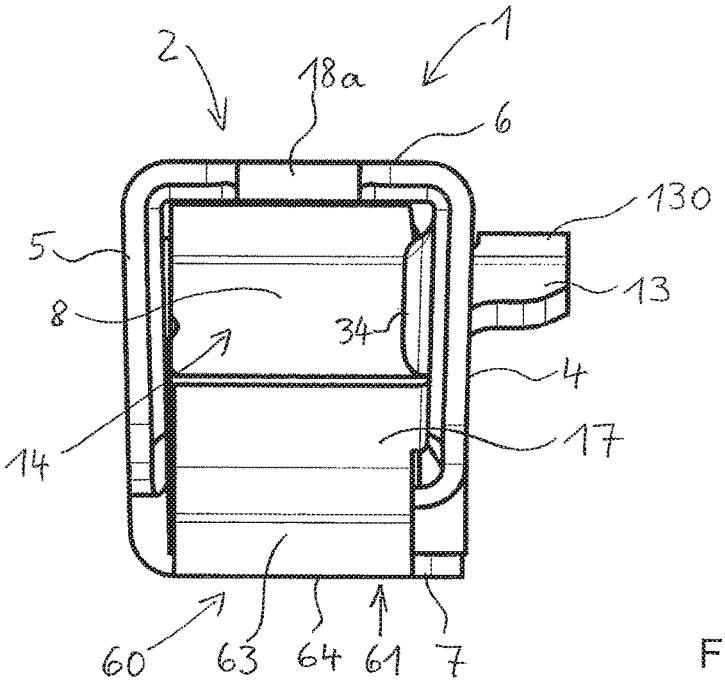
FIG. 3 illustrates a front view of the conductor connection contact element shown in FIG. 1.

The actuating lug 13 that forms an actuating portion lies adjacent to this clamping edge when viewed in a transverse manner with respect to the longitudinal extension direction of the clamping portion 11. As illustrated in FIG. 3, a conductor guiding element 34 adjoins the clamping portion 11 that is located in the inner space of the current rail piece 2, said conductor guiding element being formed on the first side wall 4. For this purpose, a portion of the first side wall 4 that lies between the insertion region to the clamping portion 11 and the actuating portion is oriented in an oblique manner in the direction of the opposite-lying second side wall 5 and in the direction of the clamping portion 11. An electrical conductor that is inserted into the conductor inserting duct 8 is guided with the aid of this conductor guiding element 34 toward the clamping edge and this conductor or strands of a fine-stranded conductor are prevented from moving into the actuating portion and possibly exiting in the region of the actuating lug 13 through the opening 12 out of the current rail piece 2.

It is furthermore clear that an overload stop 15 is provided on the first side wall 4, said overload stop being for example in the form of an overload stop lug that is facing toward the second side wall 5, and forming an end stop for the clamping portion 11. The clamping portion may only be pressed downward in the direction of the contacting portion 9 until said clamping portion abuts against the overload stop 15.

With the aid of this overload stop 15, the clamping spring 3 is in addition fixed in position on the current rail piece 2. This position fixing arrangement is achieved in addition by means of a hollow or an opening 16 in the contacting portion 9 and an embossed region or lug 45 of the base portion 7 engages in said hollow or opening. As is particularly clear in FIGS. 1 and 4, the lug 45 may be formed in the form of a material tab that is stamped out of the base portion 7 and bent over. As an option, the contacting portion 9 may also be welded, riveted, screwed or fastened to the base portion 7 in any other manner.

It is furthermore clear that in the illustrated exemplary embodiment a conductor guiding base 17 is bent out from one of the two side walls 4 and 5 in the region that lies directly upstream of the resilient bend 10. This sheet metal portion of the current rail piece 2 that forms a conductor guide is oriented facing the cover portion 6 in an oblique manner with respect to the conductor inserting direction L. As a result, a funnel-shaped conductor inserting duct 8 is produced in this region and said conductor inserting duct guides an electrical conductor at least in the lower region past the resilient bend 10 to the plane of the clamping portion 11 that extends in an oblique manner. Consequently, the conductor inserting duct 8 is delimited in this front region of the conductor connection contact element 1 by the first and second side walls 4 and 5 that are spaced apart from one another and by the cover portion 6, which extends in a transverse manner thereto, and the conductor guiding base 17 that is spaced apart therefrom.

Furthermore, it is clear that the cover portion 6 has narrower lugs 18*a*, 18*b* that freely protrude at the opposite-lying end regions from the cover portion 6 and are used to connect the current rail piece 2 during the production process in the production tool. The conductor connection contact element 1 is soldered to the circuit board on the assembly face 61, for example on the lower face of the base portion 7. The upper face of the cover portion 6 is configured as a planar suction surface for automatically populating the circuit board with a suction pad. The conductor connection contact element 1 may however inter alia also be placed with the cover portion 6 on a circuit board where it may be soldered with the lugs 18*a*, 18*b* to conductor tracks on the circuit board. The lugs 18*a*, 18*b* form the solder connection regions.

It is further apparent that, at the rear end of the current rail piece 2 that lies opposite the conductor inserting duct 8, an end stop 19 is formed by a material tab that is bent out from at least one of the side walls 4, 5. It is clear that a material tab is bent out from the first side wall 4 in the direction of the opposite-lying second side wall so as to form the end stop 19.

Figure 2:
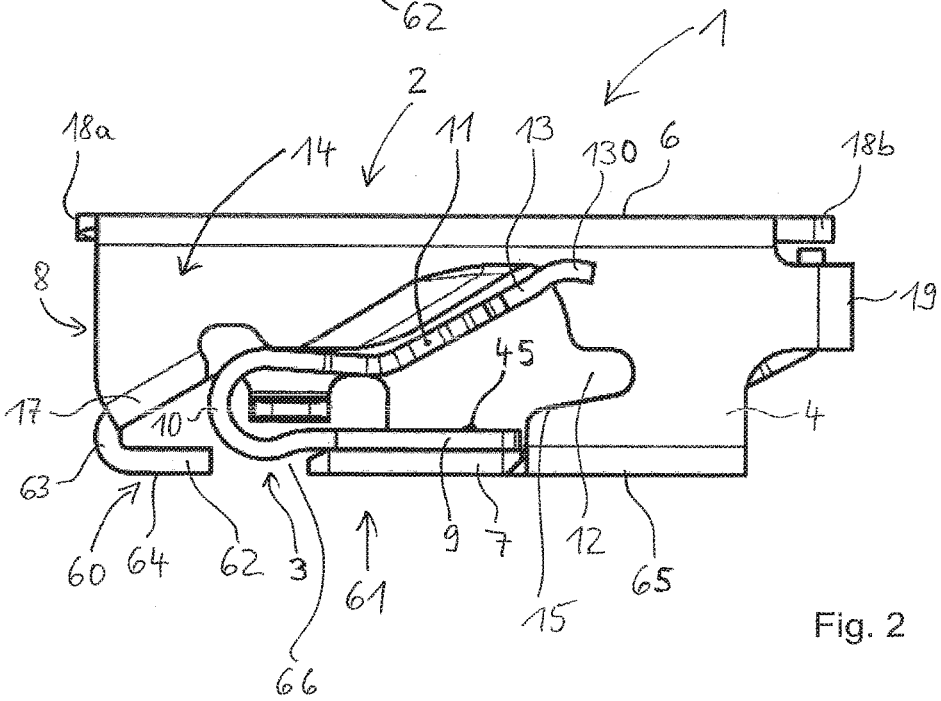
FIG. 2 illustrates a lateral view of the conductor connection contact element shown in FIG. 1.

FIG. 2 illustrates a lateral view of the conductor connection contact element 1 shown in FIG. 1. It is clear that the overload stop 15 is directly adjacent to the contacting portion 9. As a result, the clamping spring 3 is prevented from moving in the conductor inserting direction L.

It is also apparent that the conductor guiding base 17 when viewed in the conductor inserting direction L is placed upstream of the resilient bend 10 and configured in an oblique manner such that the conductor guiding base 17 that is indicated by the bend fold is continued somewhat above the transition between the resilient bend 10 and the clamping portion 11 that adjoins thereto. An electrical conductor is consequently guided in a secure and reliable manner to the plane of the clamping portion 11 without abutting against the resilient bend 10. The conductor guiding element 34 that is formed on the first side wall 4 extends spaced apart therefrom. Said conductor guiding element is formed from the first side wall 4 in the direction toward the opposite-lying second side wall 5. It is connected substance-to-substance to the first side wall 4 and can be cut free in part regions for example in the upper portion from the first side wall 4. The conductor guiding base 17 can be bent out as desired from the first side wall 4 or from the second side wall 5.

It is also clear that the actuating lug 13 that is provided on the actuating portion protrudes sideward out of the opening 12 and the opening 12 renders it possible for the clamping portion 11 to move unhindered in the direction of the contacting portion 9 so as to open the clamping site. The overload stop 15 also does not stand in the way of the actuating lug 13. On the contrary, rather than the travel of the clamping portion 11 being limited by means of the overload stop, the travel is limited by the region of the clamping portion 11 that comprises the clamping edge and adjoins the actuating lug. The actuating lug 13 comprises an end portion 130 that is slightly curved and protrudes beyond the opening 12 in the conductor inserting direction L, said end portion renders it possible to manually actuate the actuating lug 13 in an improved manner.

The conductor connection contact element 1 comprises on its assembly face 61 a first SMD-solder contact 60 and a second SMD-solder contact 65 and it is possible using said assembly face 61 to solder the conductor connection contact element 1 to a circuit board. The first SMD-solder contact 60 is arranged near the site at which it is possible to insert an electrical conductor into the conductor connection contact element, the second SMD-solder contact 65 is arranged further downstream, for example below the contacting portion 9 of the clamping spring 3 or even further downstream. The base portion 7 is not configured in a continuous manner between the first SMD-solder contact 60 and the second SMD-solder contact 65 but rather said base portion is interrupted or comprises a recess 66 that extends over the entire width of the conductor connection contact element 1.

The first SMD-solder contact 60 is configured by means of an extended material portion 62 of the current rail piece 2 that in the conductor inserting region 14 protrudes from the conductor guiding base 17, for example, in the opposite direction to the conductor inserting direction L. The material portion 62 is bent over a curved region 63 initially in the direction of the circuit board, not further illustrated, or the assembly face 61. In the embodiment in the FIGS. 1 to 3, this material portion 62 is bent over the curved region 63 at an angle of more than 90° to the first SMD-solder contact 60. The first SMD-solder contact 60 comprises a contact area 64 that is configured so as to make contact with a contact surface of the circuit board. In an advantageous manner, the contact area 64 is located in a plane that comprises the contact area of the second SMD-solder contact 65, said contact area of the second SMD-solder contact 65 being provided on the assembly face 61. The free end of the material portion 62 faces in the direction of the second SMD-solder contact 65 or extends in the conductor inserting direction L.

As is apparent in the exemplary embodiment shown in FIGS. 1 to 3, the material portion 62 that is bent to form the first SMD-solder contact 60 is comparatively long. In order to save material, this material portion 62 may also be kept shorter, as illustrated in the embodiment shown in FIGS. 4 and 5. It is apparent that the material portion 62 is in turn bent over a curved region 63 from the conductor guiding base 17 in the direction of the assembly face 61, wherein in this case the curved region 63 has a curvature of less than 90°. In this case, the end-face end surface of the material portion 62 forms the contact area 64 that may also be arranged in this case in the same plane as the contact area of the second SMD-solder contact 65.

Figure 6:
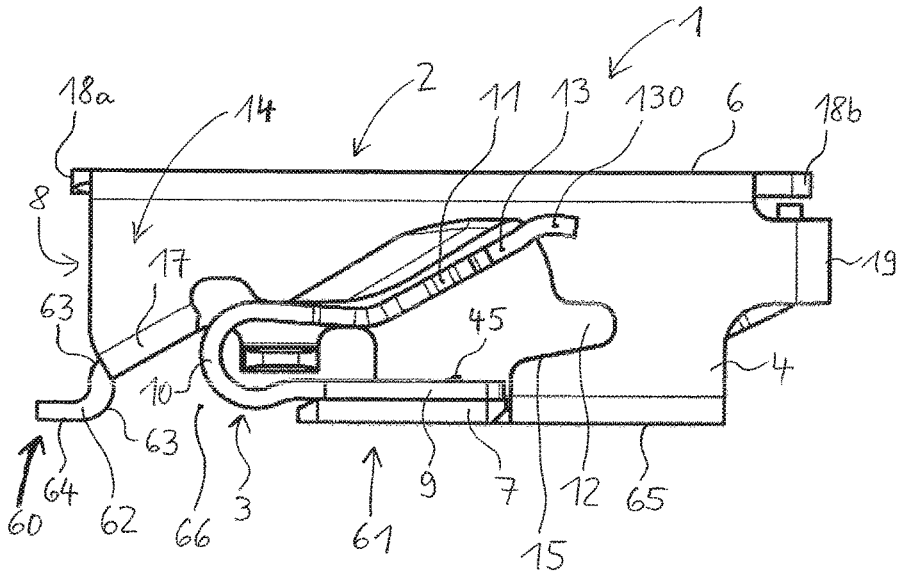
FIG. 6 illustrates a lateral view of a third embodiment of a conductor connection contact element.

FIG. 6 illustrates a further embodiment in which the first SMD-solder contact is bent over two curved regions 63 that each curve in the opposite direction to form the first SMD-solder contact 60. In this case, a slightly longer material portion 62 is in turn required, similar to the embodiment shown in FIGS. 1 to 3, wherein in contrast to the embodiment shown in FIGS. 1 to 3 the other (opposite-lying) surface face of the material portion 62 forms the contact area 64. Consequently, the free end of the material portion 62 extends in the opposite direction to the conductor inserting direction L. In the case of the embodiment shown in FIGS. 1 to 3, the contact area is formed by means of the same surface face of the conductor guiding base 17 or of the material portion 62 that also guides an electrical conductor that is to be inserted, whereas in the case of the embodiment shown in FIG. 6 it is the surface face that faces away therefrom.

Figure 4:
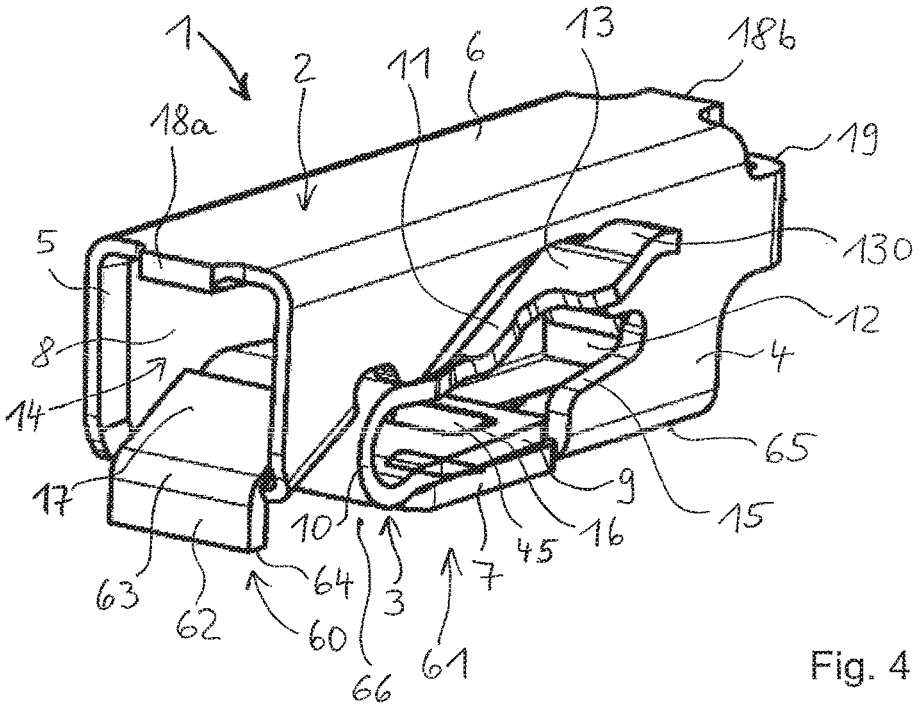
FIG. 4 illustrates a perspective view of a second embodiment of a conductor connection contact element.
Figure 5:
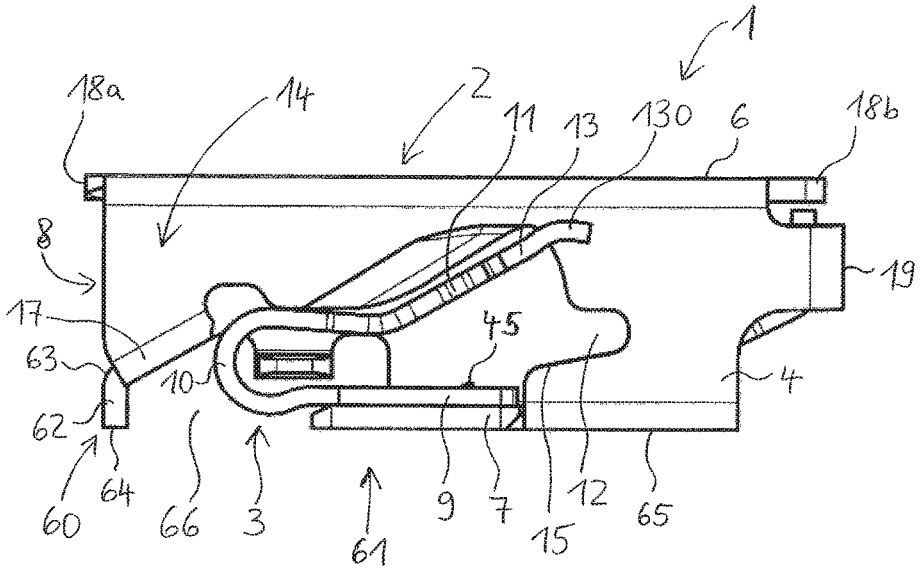
FIG. 5 illustrates a lateral view of the conductor connection contact element shown in FIG. 4.
Figure 7:
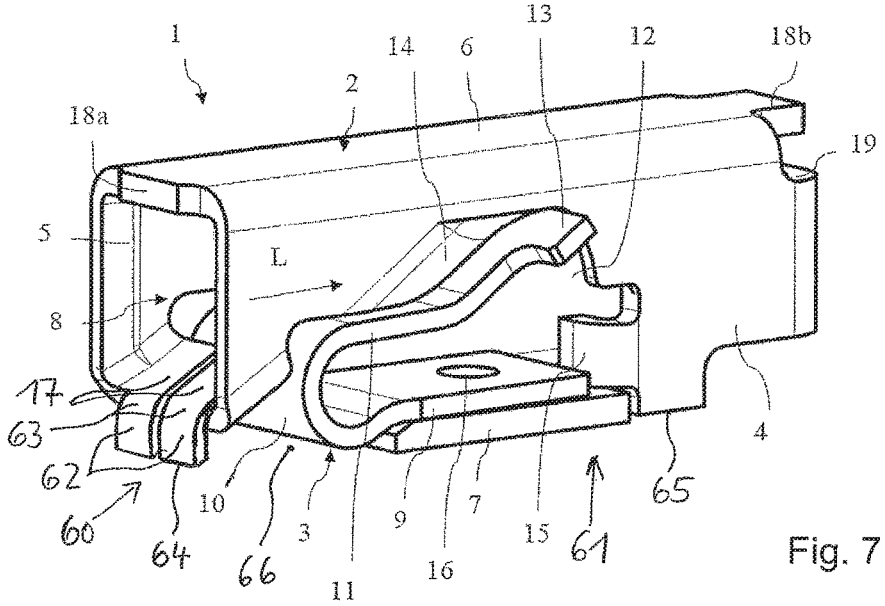
FIG. 7 illustrates a perspective view of a fourth embodiment of a conductor connection contact element.
Figure 8:
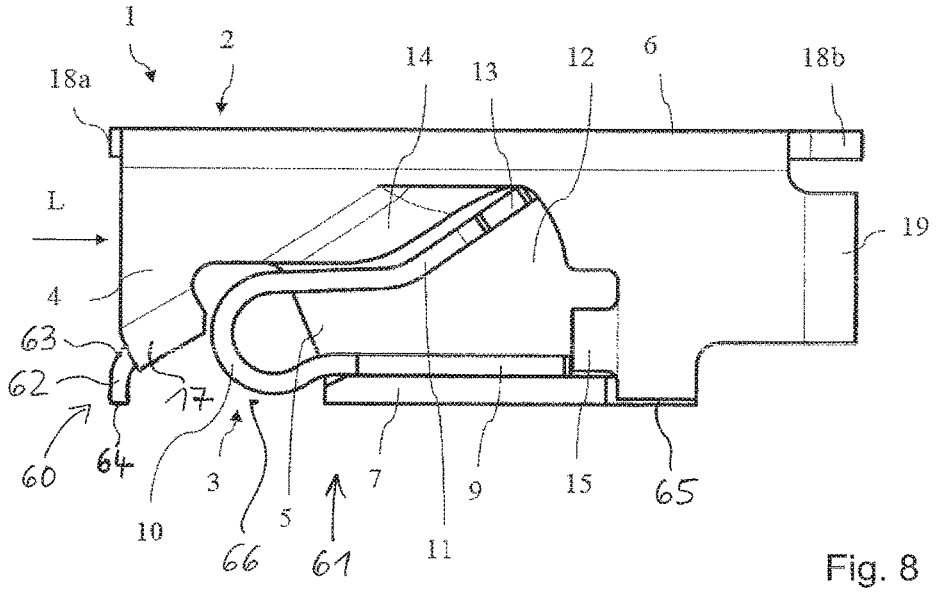
FIG. 8 illustrates a lateral view of the conductor connection contact element shown in FIG. 7.
Figure 9:
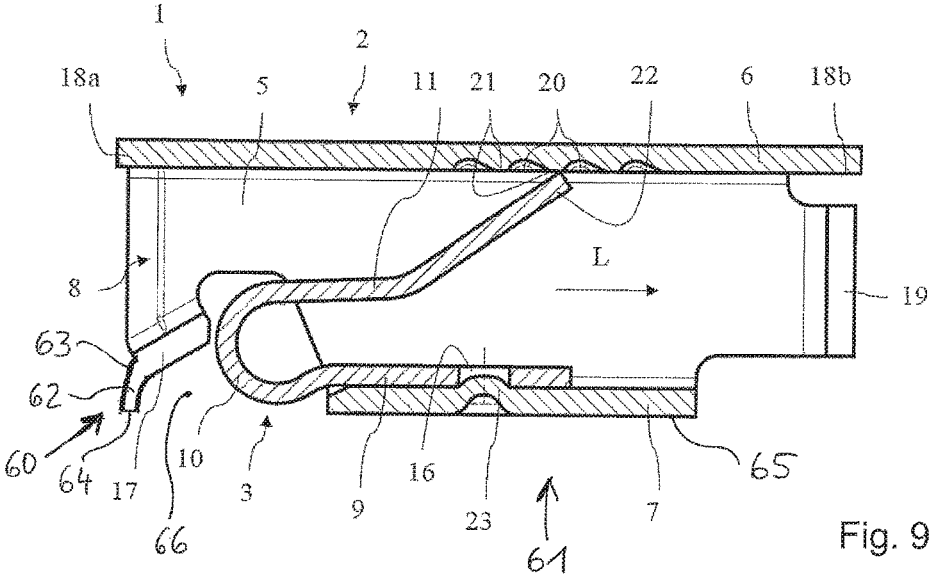
FIG. 9 illustrates a lateral sectional view through the conductor connection contact element shown in FIG. 8.

FIGS. 7 to 9 illustrate a further embodiment of the first SMD-solder contact 60 that has a comparable shape to the embodiment shown in FIGS. 4 and 5, at least in the lateral view. In contrast to the previously mentioned embodiments, the current rail piece in the case of FIGS. 7 to 8 is shaped in such a manner that the conductor guiding base 17 is configured in two parts, wherein one part is formed by a material portion that is bent out from the first side wall 4 and the other part is formed by a material portion that is bent out from the second side wall 5. Accordingly, the conductor guiding base 17 comprises an elongated slot.

In this embodiment, the material portion 62 that protrudes from the conductor guiding base 17 and is bent so as to form the first SMD-solder contact 60 may be provided either only on one face of the conductor guiding base 17, in other words on the face of the first side wall 4 or of the second side wall 5, or as illustrated in FIGS. 7 to 9 on the two parts of the conductor guiding base 17. Since the two parts are in any case electrically connected to one another via the current rail piece 2, they also form in this shape an SMD-solder contact 60 that is one part at least from the electrical point of view.

Moreover, it is apparent in the case of the embodiment shown in FIGS. 7 to 9 that the actuating lug 13 may also be realized without the extension region 130 and accordingly may protrude in a stub-like manner to the side.

The two-part embodiment of the conductor guiding base 17 that is illustrated in an oblique manner in the figure may also be combined with the embodiment of the first SMD-solder contact 60 according to the first exemplary embodiment (FIGS. 1 to 3) and the first SMD-solder contact 60 according to the third exemplary embodiment (FIG. 6).

FIG. 9 illustrates a lateral sectional view of the conductor connection contact element 1 shown in FIG. 8. It is clear that the inner face of the cover portion 6 has embossed regions 20 that form clamping protrusions 21. It is furthermore apparent that the clamping portion 11 comprises at its freely-movable end a clamping edge 22 that lies against the inner face of the cover portion 6 in the illustrated idle state without an inserted electrical conductor. It ends for example on such a clamping protrusion 21. An electrical conductor that is inserted and clamped between the clamping edge 22 and at the clamping protrusion 21 is consequently clamped under optimal surface pressure and reduced transition resistance against the current rail piece 2 by means of the clamping force of the clamping spring 3. The clamping force of the clamping spring 3 is concentrated on the reduced area of the clamping protrusion 21 with the result that the force acting per area unit (surface pressure) is increased.

Furthermore, it is clear that on the opposite-lying face the contacting portion 9 is supported on the base portion 7. As a consequence, the position is fixed by virtue of an embossed region 23 in the base portion engages in the opening 16 of the contacting portion 9. The clamping spring 3 is consequently prevented from sliding out of position in the conductor inserting direction L. Moreover, the clamping spring 3 lies with the contacting portion 9 and the clamping portion 11 against the second side wall 5 with the result that the clamping spring 3 is prevented from assuming an oblique position.

Further apparent is the conductor guiding base 17 that is in an oblique position and guides an electrical conductor past the following resilient bend 10 in the front end-face open region of the conductor inserting duct 8 and also the end stop 19 at the opposite-lying end of the current rail piece 12. It is moreover clear that the resilient bend 10 opposite the inner face of the base part 7 extends offset toward the outside (downward in the figure) and consequently is arranged in a region between the planar portion of the base part 7 and the conductor guiding base 17.

Figure 10:
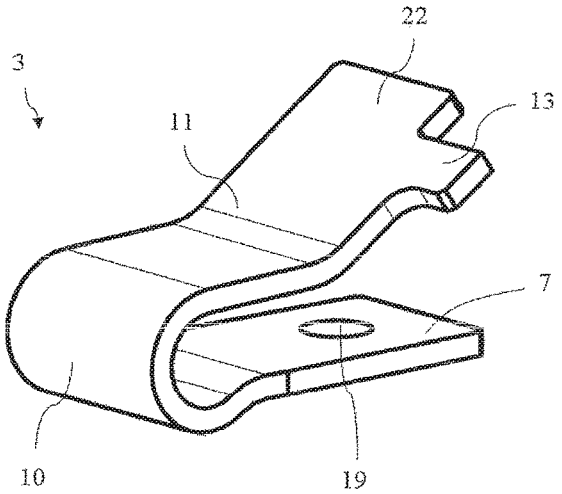
FIG. 10 illustrates a perspective view of the clamping spring of the conductor connection contact element shown in FIGS. 7 to 9.

FIG. 10 illustrates a perspective view of the clamping spring 3 for the conductor connection contact element 1 shown in FIGS. 1 to 9. It is clear that the clamping portion 11 comprises a clamping edge 22 over the substantial part of its width and said clamping portion 11 is adjoined at the side by an actuating portion having the actuating tab 13 that protrudes sideward. Consequently, the actuating portion having the actuating tab 13 is positioned when viewed in a transverse manner with respect to the longitudinal extension direction of the clamping portion 11 adjacent to the region of the clamping edge 22, in other words at the lateral edge of the clamping portion 11.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection contact element for clamping an electrical conductor, the conductor connection contact element comprising:

at least one resilient force clamping connection having a clamping site for fixedly clamping the electrical conductor, the conductor connection contact element configured as an (SMD-) conductor connection contact element that is adapted to be surface-mounted on an electrical circuit board;

at least one first SMD-solder contact arranged on an assembly face of the conductor connection contact element and configured for soldering to a contact surface of the circuit board;

a conductor inserting region formed by a sheet metal part of the conductor connection contact element;

at least one conductor guiding base that is oriented in an oblique manner with respect to the conductor inserting direction so as to form a guiding surface for the electrical conductor that is to be inserted; and a material portion of the sheet metal part that is provided in the conductor inserting region and protrudes from the conductor guiding base being adapted to be bent over at least one curved region in a direction of a plane of an assembly face to form a first SMD-solder contact and at least one part region of the conductor guiding base that is oriented in an oblique manner with respect to the conductor inserting direction is adjacent to the at least one curved region.

2. The conductor connection contact element according to the claim 1, wherein the first SMD-solder contact comprises a contact area that is configured so as to make contact with the contact surface of the circuit board, and wherein the contact area is spaced apart from the conductor guiding base over the at least one curved region.

3. The conductor connection contact element according to the claim 2, wherein the contact area is formed by an end-face end surface of the material portion of the sheet metal part that protrudes from the conductor guiding base or by a surface of the material portion that adjoins the outer face of the at least one curved region.

4. The conductor connection contact element according to the claim 1, wherein the material portion of the sheet metal part that protrudes from the conductor guiding base is bent over precisely one curved region or over two curved regions that each curve in an opposite direction to form the first SMD-solder contact.

5. The conductor connection contact element according to the claim 1, wherein the conductor connection contact element comprises, in the conductor inserting region, a conductor inserting duct that comprises the conductor guiding base.

6. The conductor connection contact element according to the claim 1, wherein the clamping site is arranged when viewed in the conductor inserting direction downstream of the conductor guiding base and/or downstream of the first SMD-solder contact.

7. The conductor connection contact element according to the claim 1, wherein the first SMD-solder contact protrudes in an opposite direction to the conductor inserting direction from the conductor guiding base over the conductor inserting region of the conductor connection contact element.

8. The conductor connection contact element according to the claim 1, wherein the conductor guiding base is formed by at least two mutually separate material portions of the sheet metal part or different sheet metal parts, and wherein the first SMD-solder contact is formed from an extended material portion from one of the sheet metal parts or from the sheet metal parts.

9. The conductor connection contact element according to the claim 1, wherein the conductor connection contact element comprises a second SMD-solder contact that is arranged in the conductor inserting direction downstream of the first SMD-solder contact.

10. The conductor connection contact element according to the claim 1, wherein the conductor connection contact element comprises as parts of the resilient force clamping connection for clamping an electrical conductor a current rail piece that is formed from the sheet metal part of the conductor connection contact element or from another sheet metal part having:

a first side wall and a second side wall that is lying opposite the first side wall, a base portion that extends from the first side wall to the opposite-lying second side wall, and a cover portion that lies opposite the base portion and extends from the first side wall towards an opposite-lying second side wall, wherein the side walls together with the cover portion and the base portion or the conductor guiding base delimit a conductor inserting duct, and a clamping spring arranged on the current rail piece and at a first end region comprises a contacting portion and at a second end region that lies opposite the first end region comprises a clamping portion having a clamping edge for clamping the electrical conductor, wherein the contacting portion is arranged on the base portion of the current rail piece, and wherein the clamping portion extends with a freely-movable end toward the cover portion.

11. The conductor connection contact element according to the claim 10, wherein an actuating portion that is accessible for an actuating tool is provided when viewed in a transverse manner with respect to the conductor inserting direction of the clamping portion in a direction of the side wall adjacent to the clamping edge.

12. The conductor connection contact element according to the claim 11, wherein the actuating portion is configured as an actuating lug that protrudes sideward at the clamping portion of the clamping spring and that protrudes sideward out of the first side wall.

13. The conductor connection contact element according to the claim 12, wherein the first side wall has an opening for a through-passage of the actuating lug.

14. The conductor connection contact element according to the claim 11, wherein a conductor guiding element that adjoins the clamping portion is formed on the first side wall, wherein the conductor guiding element comprises a portion of the first side wall that is oriented in an oblique manner in the direction of the opposite-lying second side wall.

15. The conductor connection contact element according to the claim 14, wherein the conductor guiding element is oriented facing away from an end edge of the first side wall that delimits the opening and lies opposite the second side wall.

16. The conductor connection contact element according to the claim 14, wherein the conductor guiding element comprises a material tongue of the first side wall that is oriented in an oblique manner in the direction of the second side wall and toward the clamping portion.

17. The conductor connection contact element according to the claim 11, wherein the actuating portion has an actuating lug that extends in the direction of the plane of the cover portion.

18. The conductor connection contact element according to the claim 11, wherein the actuating portion has an actuating lug that is arranged sideward when viewed in the conductor guiding direction downstream of the free end of the conductor guiding element in an opening in the first side wall, the opening being accessible from an outside.

19. The conductor connection contact element according to the claim 11, wherein at a rear end of the current rail piece that lies opposite the conductor inserting duct, an end stop is formed by a material tab that is bent out from a side wall from the base portion or from the cover portion.

20. The conductor connection contact element according to the claim 19, wherein material tabs are bent out from the side walls toward one another and form the end stop.

21. The conductor connection contact element according to the claim 11, wherein the contacting portion is clamped between the side walls and the base portion.

22. The conductor connection contact element according to the claim 11, wherein the contacting portion is fixed in position on the current rail piece by a fixing portion that protrudes from the contacting portion into an opening of the base portion or by a fixing portion that protrudes from the base portion into an opening of the contacting portion.

23. The conductor connection contact element according to the claim 22, wherein the fixing portion is a lug or an embossed region.

24. The conductor connection contact element according to the claim 11, wherein the clamping spring has a resilient bend that connects the contacting portion to the clamping portion, wherein, from at least one side wall, the conductor guiding base is arranged when viewed in the conductor inserting direction upstream of the resilient bend and is bent in the direction of the opposite-lying side wall, and wherein the conductor guiding base is oriented in an oblique manner in the conductor inserting direction facing the cover portion.

25. The conductor connection contact element according to the claim 11, wherein the cover portion or the base portion has a solder connection region.

26. The conductor connection contact element according to the claim 11, wherein an overload stop for the clamping portion is provided on a side wall.

* * * * *